US011533989B1

(12) United States Patent
Haroutunian

(10) Patent No.: US 11,533,989 B1
(45) Date of Patent: Dec. 27, 2022

(54) COMBINATION STAND ASSEMBLY

(71) Applicant: Jackob Haroutunian, Los Angeles, CA (US)

(72) Inventor: Jackob Haroutunian, Los Angeles, CA (US)

(73) Assignee: UNIFIED GLOBAL PRODUCTS LLC, Van Nuys, CA (US)

( * ) Notice: Subject to any disclaimer, the term of this patent is extended or adjusted under 35 U.S.C. 154(b) by 0 days.

(21) Appl. No.: 17/837,099

(22) Filed: Jun. 10, 2022

(51) Int. Cl.
*A47B 9/20* (2006.01)
*A47B 23/00* (2006.01)

(52) U.S. Cl.
CPC ..... *A47B 9/20* (2013.01); *A47B 23/001* (2013.01)

(58) Field of Classification Search
CPC .. A47B 85/00; A47B 23/001; A47B 2009/006
USPC ..... 108/11, 10, 49, 12, 116, 124, 157.1, 14, 108/43, 39; 248/161
See application file for complete search history.

(56) References Cited

U.S. PATENT DOCUMENTS 1,402,929 A * 1/1922 Herpst ..... A47B 43/00 108/134
1,861,305 A * 5/1932 Fasching ..... A47B 23/001 108/19
2,628,143 A * 2/1953 Stickley ..... A47B 1/02 108/106
2,692,175 A * 10/1954 Jacques ..... A47B 5/006 108/115
3,240,170 A * 3/1966 Shave ..... A47B 43/00 108/115
3,894,709 A * 7/1975 Weir ..... A47B 23/007 248/445
5,438,938 A * 8/1995 Meeker ..... A47B 31/00 108/127
6,669,214 B1 * 12/2003 Domis ..... B25H 3/00 280/47.35
6,694,891 B1 * 2/2004 Lai ..... A47B 19/08 248/150
2007/0095257 A1 * 5/2007 Hernandez ..... A47B 3/0815 108/115
2007/0256611 A1 * 11/2007 Huang ..... A47B 3/08 108/116
2007/0289506 A1 * 12/2007 Branch ..... A47B 23/046 29/700
2008/0250988 A1 * 10/2008 Merey ..... A47B 3/091 108/124

(Continued)

*Primary Examiner* — Jose V Chen
(74) *Attorney, Agent, or Firm* — Cohen IP Law Group, PC; Michael N. Cohen

(57) ABSTRACT

A combination stand assembly is provided. The assembly includes a dual-use stand adapted to provide a floor stand and/or a bed top stand. The combination stand includes a floor base configured with a telescoping upright support structure and a top tray. The top tray may be used to support various items such as, but not limited to, a laptop computer. The top tray is removable from the upright support structure and includes extendable legs so that the tray, when separated from the upright support, may be used as a self-contained secondary stand (e.g., for use as a bed top stand). In this way, the combination stand may be configured for use as a floor stand and/or for use as a bed top stand. The angle of the tray is adjustable in either configuration for ergonomic positioning.

20 Claims, 12 Drawing Sheets

(56) References Cited

U.S. PATENT DOCUMENTS

2009/0241805 A1* 10/2009 Hernandez ..... A47B 3/0815
108/115
2013/0284077 A1* 10/2013 Copeland ..... A47B 3/08
108/115

* cited by examiner

COMBINATION STAND ASSEMBLY

FIELD OF THE INVENTION

This invention relates to stands, including a combination laptop stand that transitions from a floor stand to a bed top stand.

BACKGROUND

The use of laptop computers in the home and business has become ubiquitous throughout the world. Not only are laptop computers used for work, laptops also are used for streaming entertainment such as movies, series, sports, educational content, and other types of streaming content. Accordingly, laptops are used in the office, and throughout the home (e.g., in the living room, in the bedroom, etc.).

Depending on where a laptop may be used, it may require a different type of stand for maximum efficiency. For example, when used in the home office living room, a floor-based laptop stand may be employed, but when used in the home bedroom, a bed top laptop stand may be much more efficient and comfortable. Accordingly, in order to use a laptop in both settings, a user may be required to own both a floor-based laptop stand and a separate bed top stand.

However, owning two stands may not be convenient for a user due to space and cost restrictions.

Accordingly, there is a need for a laptop stand that may be used as both a floor based stand and as a bed top stand. There also is a need for a laptop stand that easily transitions between a floor based stand to a bed top stand.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the combination stand assembly according to exemplary embodiments hereof includes a dual-use stand adapted to provide a floor stand and/or a bed top stand. The combination stand includes a floor base configured with a telescoping upright support structure and a top tray. The top tray may be used to support various items such as, but not limited to, a laptop computer, a tablet computer, an eBook, books and magazines, food and beverages, and/or any other appropriate items. The top tray is removable from the upright support structure and includes extendable legs so that the tray, when separated from the upright support, may be used as a self-contained secondary stand (e.g., for use as a bed top stand). In this way, the combination stand may be configured for use as a floor stand and/or for use as a bed top stand. The angle of the tray is adjustable in either configuration for ergonomic positioning.

Figure 1:
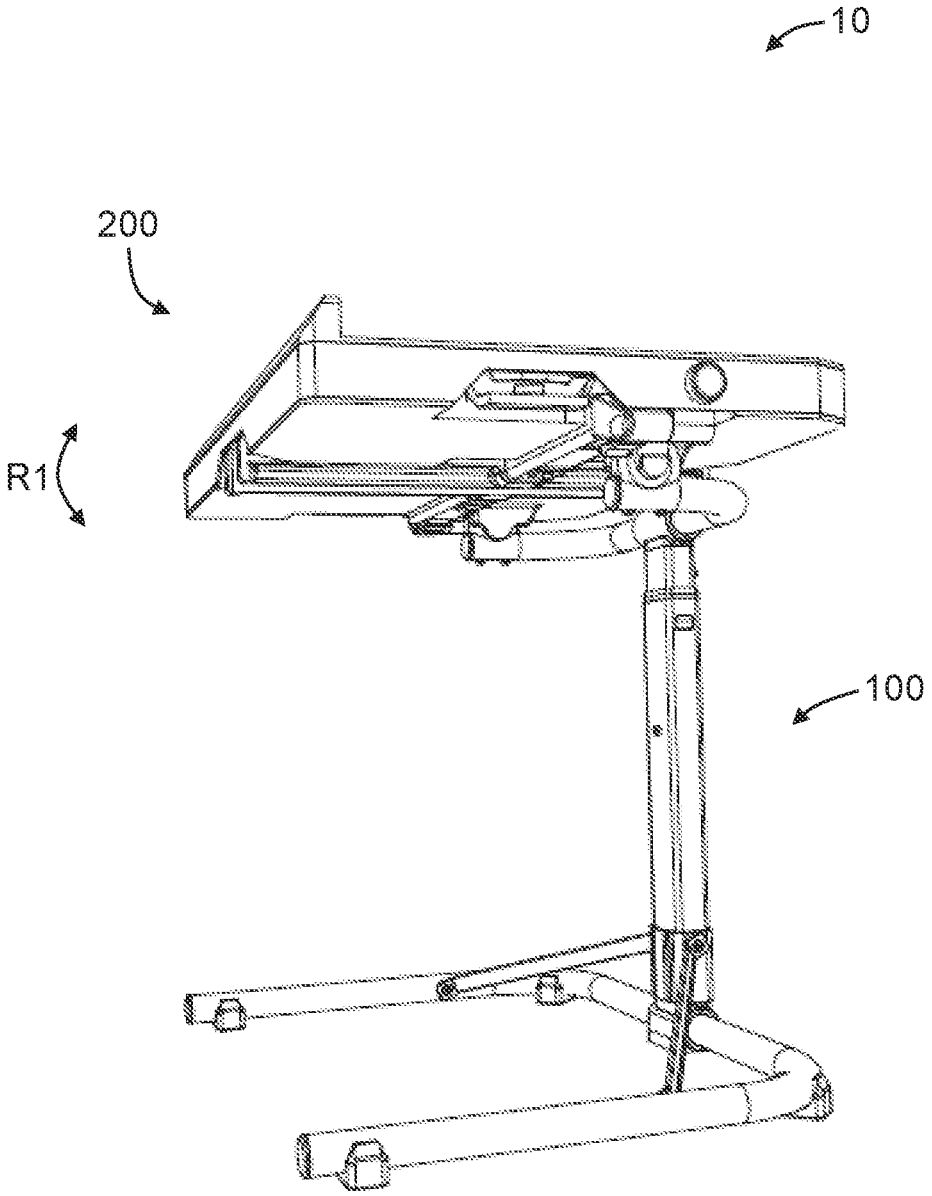
FIG. 1 shows a schematic of a combination stand assembly according to exemplary embodiments hereof.
Figure 2:
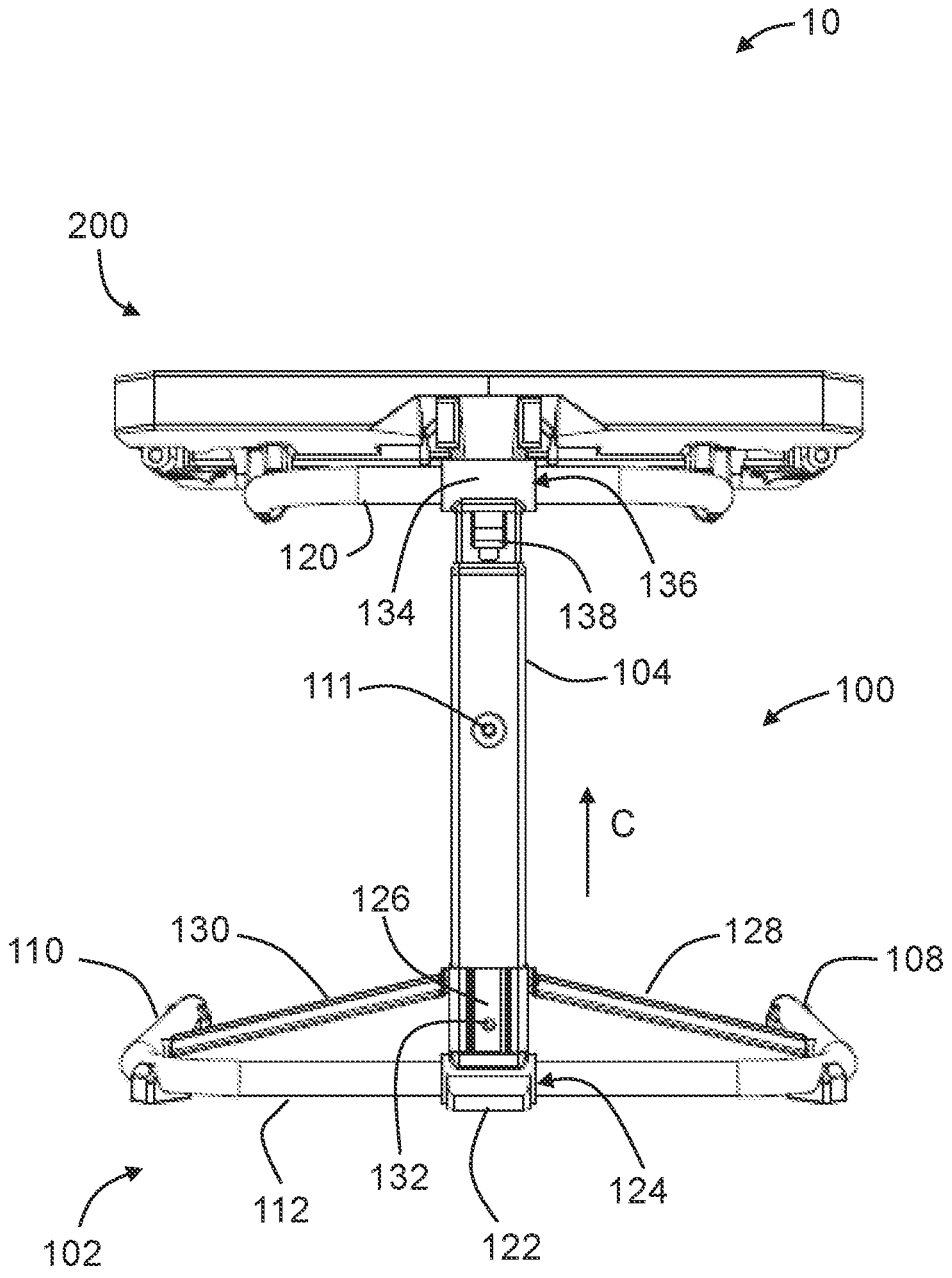
FIG. 2 shows a rear view of a combination stand assembly according to exemplary embodiments hereof.
Figure 3:
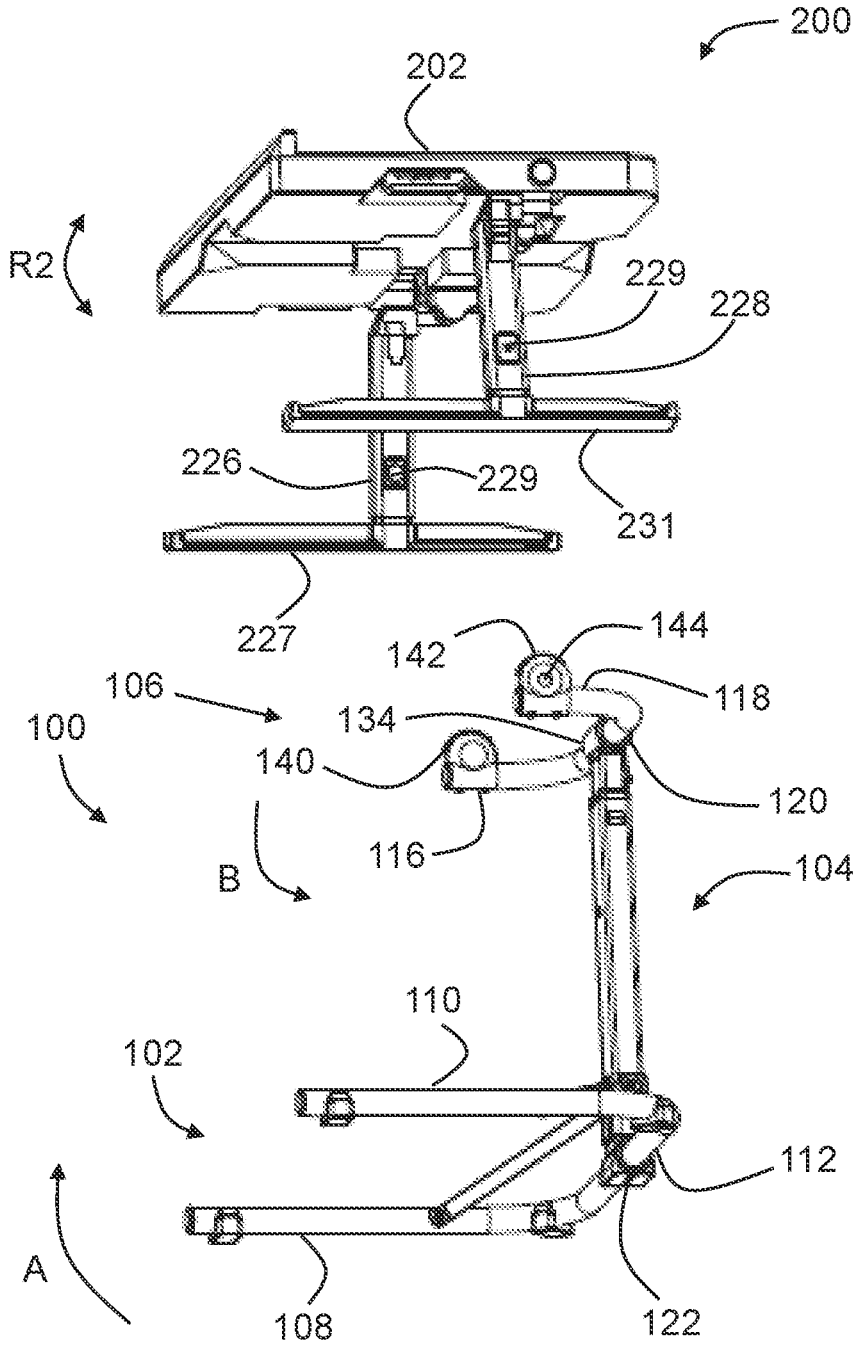
FIG. 3 shows a removable tray assembly separated from a floor stand assembly according to exemplary embodiments hereof.

In one exemplary embodiment hereof, as shown in FIGS. 1-3, the combination stand assembly 10 (also referred to herein as simply the assembly 10) includes a floor stand assembly 100 and a removable tray assembly 200. FIG. 1 shows a schematic drawing of the combination stand assembly 10, FIG. 2 shows the back side view of the assembly 10, and FIG. 3 shows a separated view of the same, with the removable tray assembly 200 separated from the floor stand assembly 100 and with its legs extended. In general, the floor stand assembly 100 provides a foundational base for the overall assembly 10 for when the assembly 10 is to be used as a floor stand, and the removable tray assembly 200, when separated from the floor stand assembly 100 and with its legs extended, provides a secondary stand (e.g., a bed top stand). In addition, and as will be described in other sections, the tray assembly 200 is able to rotate (e.g., tilt) in the direction of the arrow $R_1$ in FIG. 1 with respect to the floor stand assembly 100, as well as in the direction of $R_2$ in FIG. 2 with respect to the tray's self-contained legs. The combination stand assembly 10 also may include other assemblies, mechanisms, elements, and components as necessary to fulfill its functionalities as described herein.

In some embodiments as described herein (see FIGS. 1 and 3), the combination stand assembly 10 is designed to transition from a first configuration (e.g., a floor stand) to a second configuration (e.g., a bed top stand).

Floor Stand Assembly 100

In some embodiments as shown in FIGS. 2-3, the floor stand assembly 100 includes a base 102, an upright support structure 104, and a tray support 106. In general, the base 102 provides foundational support to the assembly 10 when the assembly 10 is resting on a flat surface (e.g., the ground), the upright support structure 104 extends upward from the base 102 to provide the assembly 10 with a desired height, and the tray support 106 provides a support structure to which the removable tray assembly 200 may be removably attached.

Accordingly, in some embodiments, it is preferable for the base 102 to include a large enough footprint to provide adequate lateral support to the assembly 10 to prevent it from tipping over, especially when the weight of a separate item (e.g., a laptop computer) is placed on the removable tray 200. In some embodiments as shown in FIG. 3, the base 102 may include a U-shaped member including a left base leg 108, a right base leg support 110, and a rear base leg support 112 coupled to and extending between the left and right base legs 108, 110. It also is understood that the base 102 may be formed as any type of shape and/or structure to adequately support the assembly 10 as is known in the art (e.g., round, square, octagonal, etc.).

In some embodiments, the upright support structure 104 includes an elongate member with a first end coupled to the base 102 (e.g., to the rear leg support 112), an elongate body extending upward (e.g., vertically), and a second end coupled to the tray support 106. In some embodiments, the upright support structure 104 is telescoping so that its length (and, accordingly, the height of the overall assembly 10) may be shortened and/or lengthened as desired. In some embodiments as shown in FIG. 2, the upright support structure 104 includes a locking pin 111 adapted to lock the upright support structure 104 at the desired telescoping length.

In some embodiments, the tray support 106 includes a U-shaped member 114 including a left tray support leg 116, a right tray support leg 118, and a rear tray support leg support 120 coupled to and extending between the left and right tray support legs 116, 118. It also is understood that the tray support 106 may be formed as any type of shape and/or structure to adequately support the removable tray assembly 200 as is known in the art.

In some embodiments as shown in FIGS. 2-3, the base 102 is rotatably coupled to the upright support structure 104 so that the base 102 may transition from a lower position for resting on the ground (as shown in FIG. 3) to an upright position for stowage (as described in other sections). In some embodiments as shown in FIG. 2, the base's rear leg support 112 is rotatably coupled to the first end of the upright support structure 104 using a lower coupler 122. The lower coupler 122 is attached to the first end of the upright support structure 104 and includes a left-to-right through-hole 124 (generally orthogonal to the upright support structure 104) through which the base's rear leg support 112 may pass. In this way, the base's rear leg support 112 may rotate within the coupler's through-hole 124 thereby enabling the base 102 and the left and right legs 108, 110 to rotate upward in the direction of the arrow A (FIG. 3) about the coupler 122 from a lower position to an upper position (for stowage), and subsequently from the upper position to the lower position (in a direction opposite to the arrow A) for resting on the ground.

In some embodiments as shown in FIG. 2, the floor stand assembly 100 includes a sheath 126 adapted to (at least partially) encircle the upright support structure 104 and to slide thereupon. A left sheath support arm 128 rotatably extends from the left leg 108 to the sheath 126, and a right sheath support arm 130 rotatably extends from the right leg 110 to the sheath 126. As the sheath 126 is caused to move upward in the direction of arrow C, the left and right sheath support arms 128, 130 pull on the left and right legs 108, 110, respectively, causing the left and right legs 108, 110 and the overall base 102 to rotate upward in the direction of the arrow A of FIG. 3 about the through-hole 124. As the sheath 126 is caused to move downwards upon the upright support structure 104, the left and right sheath support arms 128, 130 push the left and right legs 108, 110, respectively, downward in a direction generally opposite the arrow A. In this way, up and down movement of the sheath 126 causes up and down rotation of the base 102 about the coupler's through-hole 124.

In some embodiments, the upright support structure 104 and the sheath 126 include one or more locking pin-hole combinations 132 configured to releasably lock the sheath's 126's movement along the upright support structure 104. For example, as shown in FIG. 2, the upright support structure 104 and the sheath 126 include a lower locking pin/opening combination 132 configured to releasably lock the sheath 126 in a lower position (e.g., such that the base 102 is locked in a downward position for resting on a floor), and (optionally) an upper pin/opening combination configured to releasably lock the sheath 126 in an upper position (e.g., such that the base 102 is locked in an upper position for stowage).

In some embodiments as shown in FIGS. 2-3, the tray support 106 is rotatably coupled to the upright support structure 104 so that the tray support 106 may transition from an upper position for supporting the tray assembly 200 generally upright (as shown in FIG. 3) to a downward position for stowage (described in other sections). In some embodiments as shown in FIG. 2, the tray support's rear leg support 120 is rotatably coupled to the second end of the upright support structure 104 using an upper coupler 134. The upper coupler 134 is attached to the second end of the upright support structure 104 and includes a left-to-right through-hole 136 (generally orthogonal to the upright support structure 104) through which the tray support's rear leg support 120 may pass. In this way, the tray support's rear leg support 120 may rotate within the upper coupler 122 thereby enabling the tray support 106 to rotate downward in the direction of the arrow B (FIG. 3) from an upper position to a lower position (for stowage), and subsequently from the lower position to the upper position (in a direction opposite to the arrow B) for supporting the tray assembly 200 generally upright.

In some embodiments as shown in FIG. 2, the upper coupler 134 includes a locking mechanism 138 to releasably lock the tray support 106 in either the upper position and/or in the lower position. In some embodiments, the locking mechanism 138 includes a slider pin mechanism that when engaged within an opening in the upper coupler 134 may releasably lock the tray support 106 in the upper or lower locked positions. Other types of locking mechanisms also may be used.

In some embodiments as shown in FIG. 3, the tray support's left leg 116 includes a left engagement disc 140 and the tray support's right leg 118 includes a right engagement disc 142. The left and right engagement discs 140, 142 are preferably coupled to an upper portion of the left and right legs 116, 118, respectively, so that the left and right engagement discs 140, 142 extend upward therefrom. As will be described in other sections, the left and right engagement discs 140, 142 may be used to releasably couple the tray assembly 200 to the tray support 106 while facilitating the up and down rotational tilting of the tray 200 assembly.

Removable Tray Assembly 200

Figure 4:
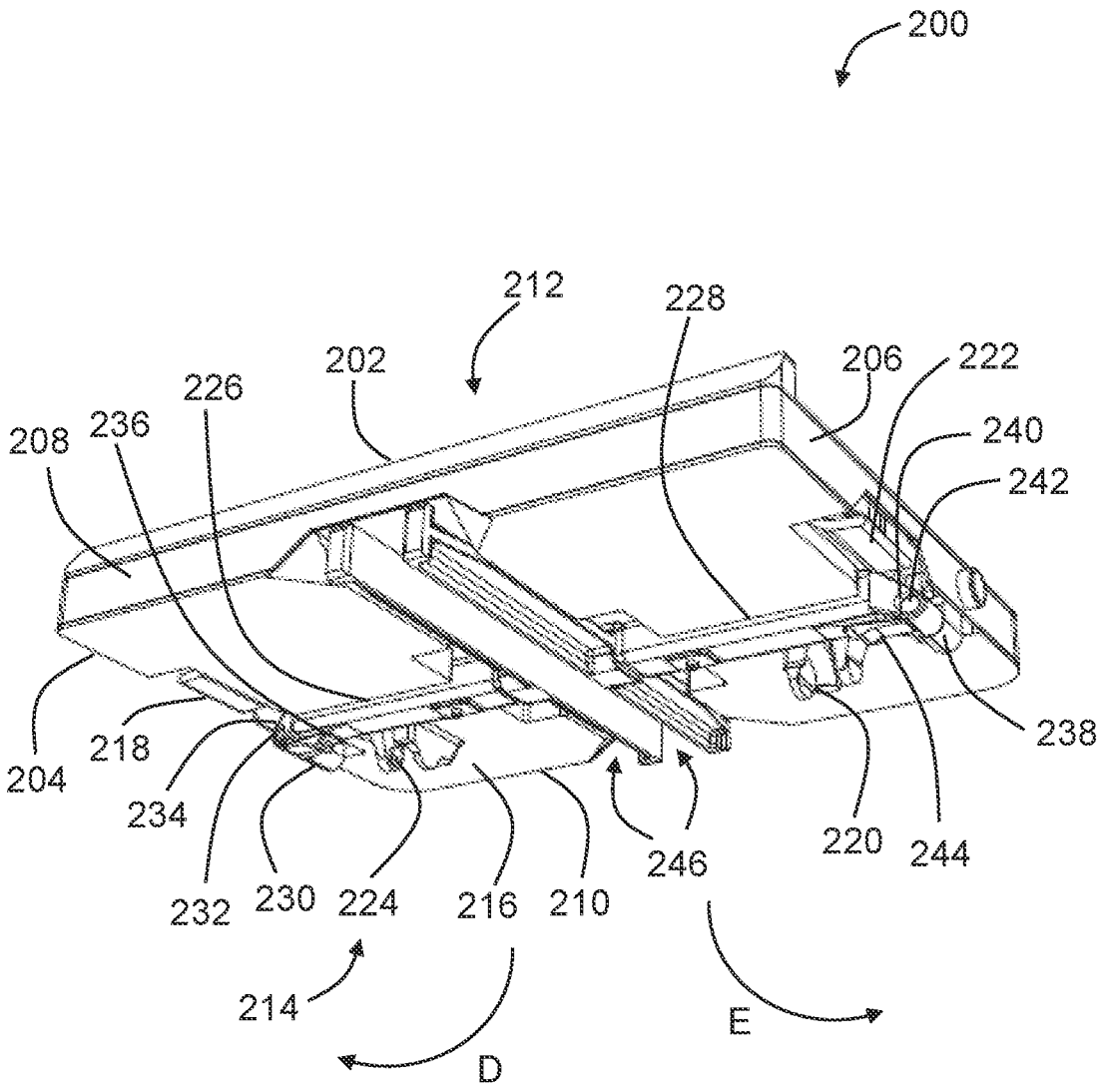
FIG. 4 shows aspects of a tray assembly according to exemplary embodiments hereof.

In some embodiments as shown in FIG. 4, the tray assembly 200 includes a tray 202 including a left side 204, a right side 206, a front side 208, a back side 210, a top side 212, and a bottom side 214. In general, the tray assembly's bottom side 214 may be releasably coupled to the floor stand assembly's tray support 106 when the overall assembly 10 is used as a floor stand and released from the tray support 106 when the tray assembly 200 is used as a standalone secondary stand.

In some embodiments as shown in FIG. 4, the tray assembly 200 includes a left engagement clamp 216 activated by a left engagement mechanism 218 (e.g., a paddle, lever, button and/or other suitable type of mechanism) and a right engagement clamp 220 activated by a right engagement mechanism 222 (e.g., a paddle, lever, button and/or other suitable type of mechanism). For example, the left engagement clamp 216 may be opened by pulling upward on the left engagement mechanism 218 and subsequently closed by releasing the left engagement mechanism 218. Similarly, the right engagement clamp 220 may be opened by pulling upward on the right engagement mechanism 222 and subsequently closed by releasing the right engagement mechanism 222. It may be preferable that the clamps 216, 222 and/or the mechanisms 218, 222 be spring-loaded to facilitate the easy opening and closing of the clamps 216, 220.

The left engagement clamp 216 is adapted to receive and releasably attach to (be clamped to) the left engagement disc 140 of the tray support 106, and the right engagement clamp 220 is adapted to receive and releasably attach to (be clamped to) the right engagement disc 142 of the tray support 106. For example, the left and right engagement clamps 216, 220 may be opened (e.g., by pulling upward on the left and right engagement mechanisms 218, 222, respectively), aligned with the left and right engagement discs 140, 142, respectively, and closed about the discs 140, 142 (e.g., by releasing the left and right engagement mechanisms 218, 222). This results in the configuration shown in FIGS. 1 and 2.

In some embodiments as shown in FIG. 3, the left and right engagement discs 140, 142 are each generally upright disc-shaped with (at least partially) circular upper circumferences. Accordingly, it is preferable that the left and right engagement clamps 216, 220 each include a corresponding internal curvature (e.g., at least partially circular) to accommodate the discs 140, 142 when the discs 140, 142 are received into the respective clamps 216, 220.

In some embodiments as shown in FIG. 3, the left and right engagement discs 140, 142 each include centered side guide openings 144 (or, optionally, protrusions) and the engagement clamps 216, 220 each include centered side protrusions 224 (or, optionally, openings) (see FIG. 4) adapted to mate with the centered side openings 144 on the respective discs 140, 142. In this way, with the discs 140, 142 received into and secured within the respective clamps 216, 220, the engagement discs 140, 142 may each rotate within the respective engagement clamps 216, 220 about the mated guide opening 144 and guide protrusion 224 combinations. As will be described in other sections, this may facilitate the up-and-down rotational tilting of the tray 200 assembly.

In some embodiments as shown in FIGS. 3-4, the tray assembly 200 includes a left folding leg 226 rotatably attached on the underside 214 of the tray 202 toward the left side 204 of the tray 202 and a right folding leg 228 rotatably attached on the underside 214 of the tray 202 toward the right side 206 of the tray 202. The left and right folding legs 226, 228 are adapted to transition from a folded position (generally overlapping and parallel with the tray 202 for stowage as shown in FIG. 4) to an extended position (extending generally downward from the tray 202 for use as a bed top stand as shown in FIG. 3).

In some embodiments, the left folding leg 226 includes a left leg base 227 coupled to its distal end. The left leg base 227 may include an elongate member coupled perpendicularly to the left folding leg 226 to provide additional lateral support to the left folding leg 226 when the left folding leg 226 is extended and in use. In some embodiments, the right folding leg 228 includes a right leg base 231 coupled to its distal end. The right leg base 227 may include an elongate member coupled perpendicularly to the right folding leg 228 to provide additional lateral support to the right folding leg 228 when the right folding leg 228 is extended and in use.

In some embodiments, the left and right folding legs 226, 228 are telescoping so that the length of each leg 226, 228 may be independently adjusted. In this way, the height of the legs 226, 228, and accordingly, the height of the tray 202 may be adjusted for use as a bed top stand. In some embodiments as shown in FIG. 3, the legs 226, 228 may each include a locking pin 229 adapted to lock the legs 226, 228 at the desired telescoping length.

In some embodiments as shown in FIG. 4, the left folding leg 226 is rotatably coupled to the tray 202 using a left folding leg coupler 230 configured with the underside 214 of the tray 202. The left folding leg 226 includes a through-hole 232 at its proximal end adapted to receive a pivot pin 234 extending from the coupler 230 thereby enabling the left folding leg 226 to rotate downward and upward (in the direction of the arrow D) about the pivot pin 232 through-hole 234 combination.

In some embodiments, the left folding leg 226 includes a locking mechanism 236 including a locking pin adapted to engage a corresponding opening in the pivot pin 234 to lock the pivot pin 234 within the through-hole 232 at a desired rotational location. In some embodiments, the pivot pin 234 includes a first opening in a position to lock the left folding leg 226 at a fully retracted position (see FIG. 4) and a second opening in a position to lock the left folding leg 226 at a fully extended position (see FIG. 3). The locking mechanism 236 may include a slider or other type of control mechanism (e.g., a button) configured to extend and/or retract the locking pin into and out of a corresponding opening in the pivot pin 234 to lock and unlock the left folding leg 226, respectively.

In some embodiments as shown in FIG. 4, when the left folding leg 226 is positioned in its fully retracted position, the left folding leg 226 is overlaid and substantially parallel with the tray's bottom side 214. In some embodiments, the tray's bottom side 214 includes one or more underside cavities 246 adapted to receive at least a portion of the left folding leg 226 when the left folding leg 226 is positioned in its fully retracted position. In some embodiments, the underside cavities 246 include front and/or rear cutouts to provide easy access to the retracted left folded leg 226.

In some embodiments as shown in FIG. 4, the right folding leg 228 is rotatably coupled to the tray 202 using a right folding leg coupler 238 configured with the underside 214 of the tray 202. The right folding leg 228 includes a through-hole 240 at its proximal end adapted to receive a pivot pin 242 extending from the coupler 238 thereby enabling the right folding leg 228 to rotate downward and upward (in the direction of the arrow E) about the pivot pin 242 through-hole 240 combination.

In some embodiments, the right folding leg 228 includes a locking mechanism 244 including a locking pin adapted to engage a corresponding opening in the pivot pin 242 to lock the pivot pin 242 within the through-hole 240 at a desired rotational location. In some embodiments, the pivot pin 242 includes a first opening in a position to lock the right folding leg 228 at a fully retracted position (see FIG. 4) and a second opening in a position to lock the right folding leg 228 at a fully extended position (see FIG. 3). The locking mechanism 244 may include a slider or other type of control mechanism (e.g., a button) configured to extend and/or retract the locking pin into and out of a corresponding opening in the pivot pin 242 to lock and unlock the right folding leg 228, respectively.

In some embodiments as shown in FIG. 4, when the right folding leg 228 is positioned in its fully retracted position, the right folding leg 228 is overlaid and substantially parallel with the tray's bottom side 214. In some embodiments, the tray's bottom side 214 includes one or more underside cavities 246 adapted to receive at least a portion of the right folding leg 228 when the right folding leg 228 is positioned in its fully retracted position. In some embodiments, the underside cavities 246 include front and/or rear cutouts to provide easy access to the retracted right folded leg 228.

In some embodiments, it may be preferable that the left leg base 227 and/or the right leg base 231 generally extend from the front 208 of the tray 202 to the back 210 of the tray 202 (or any portion thereof) when the left and right folding legs 226, 228 are fully retracted.

Tilting the Tray Assembly 200

The tray assembly 200 includes a left side rotational control mechanism 248 and a right side rotational control mechanism 248 (that generally mirrors the left side mechanism 248). Accordingly, to avoid duplicity, and for the purposes of this specification, the tilting functionalities of the tray assembly 200 will be described predominantly in relation to the left side rotational control mechanism 248 configured with the left side elements of the assembly 10. However, it is understood that the assembly 10 also includes a right side rotational control mechanism 248 configured with the right side elements of the assembly 10 and that the tilting functionalities of the tray assembly 200 generally requires activation of both the left and right side mechanisms 248 in parallel.

Figure 5:
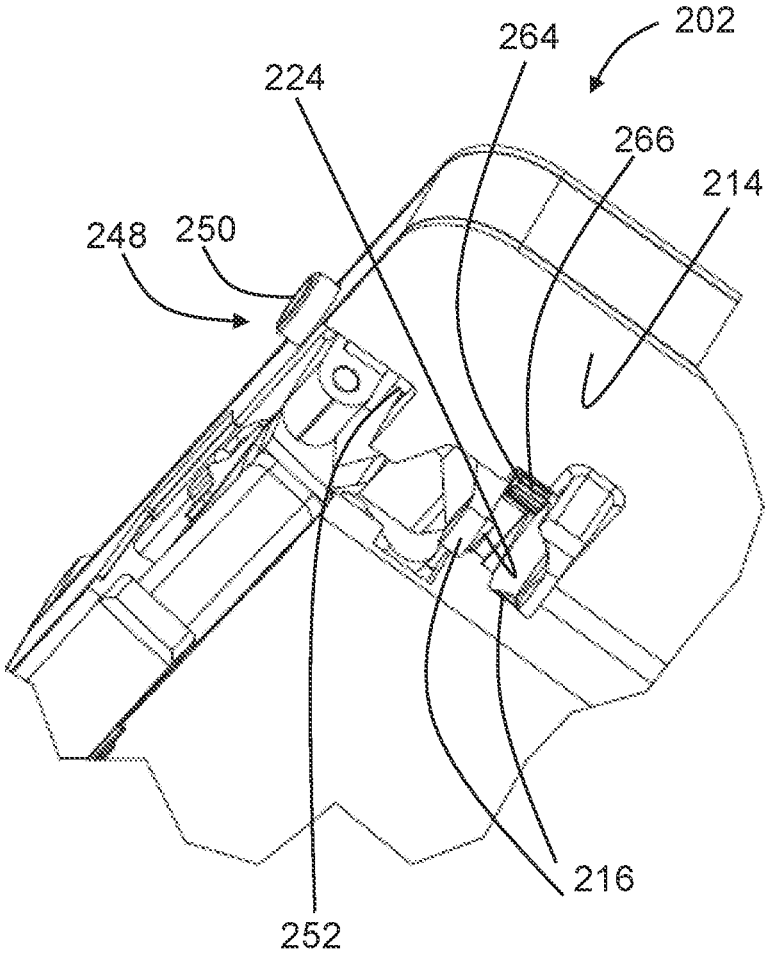
FIG. 5 shows aspects of a tray assembly according to exemplary embodiments hereof.

FIG. 5 shows the left underside 214 of the tray 202 including the left engagement clamp 216 including a centered side protrusion 224 adapted to receive and secure the left engagement disc 140 of the tray support 106 as described in other sections. In some embodiments, also shown in FIG. 5, the tray 202 includes a rotational control mechanism 248 adapted to control (e.g., lock and release) the rotational functionality of the tray 202 with respect to the floor stand assembly 100 and/or the tray's left and right folding legs 226, 228.

Figure 6:
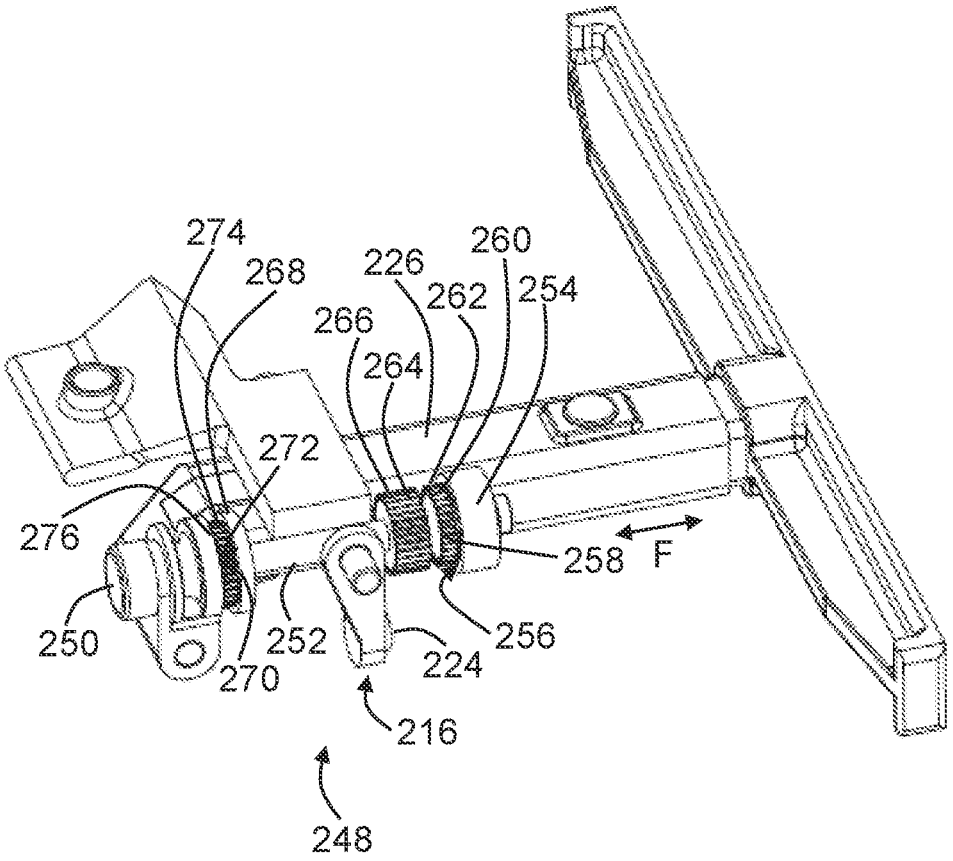
FIG. 6 shows aspects of a tray assembly according to exemplary embodiments hereof.
Figure 7:
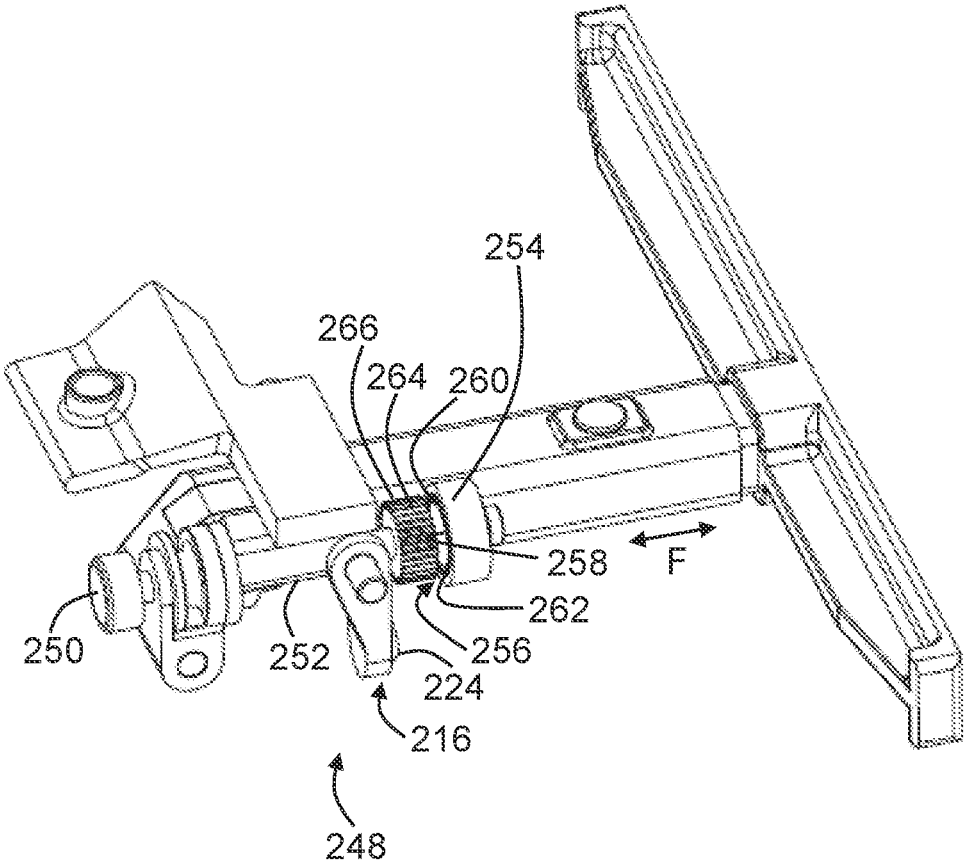
FIG. 7 shows aspects of a tray assembly according to exemplary embodiments hereof.

FIGS. 6-7 show an isolated view of the rotational control mechanism 248 of FIG. 5. In some embodiments, the rotational control mechanism 248 includes an activation mechanism 250 (e.g., a spring-loaded pushbutton) coupled to the distal end of a shaft 252 such that activation of the activation mechanism 250 (e.g., pushing the button inward and to the right and/or releasing the button to the left) causes the shaft 252 to translate longitudinally to the right and/or left, respectively, as represented by the arrow F. FIG. 6 shows the pushbutton 250 depressed (e.g., pressed in and to the right) and FIG. 7 shows the pushbutton 250 released and spring-loaded to the left.

In some embodiments as shown in FIGS. 6-7, the mechanism 248 also includes a first locking sheath 254 fixedly coupled about the circumference of the shaft 252 towards the shaft's proximal end such that longitudinal movement of the shaft 252 also causes longitudinal movement of the first locking sheath 254. The first locking sheath 254 includes a side cavity 256 including inner engagement teeth 258 on an inner circumferential surface within the cavity 256.

In some embodiments as shown in FIG. 6, the rotational control mechanism 248 includes a first locking gear 260 rotationally coupled to the shaft 252 and including outer circumferential locking teeth 262. The first locking gear 260 is fixedly coupled to an adjacent rotatable first engagement gear 264 including outer engagement teeth 266 such that fixing and or releasing the movement of the first locking gear 260 about the shaft 252 also fixes and/or releases the movement of the first engagement gear 264, respectively.

In some embodiments as shown in FIGS. 6-7, the first locking gear 260 is adapted to be received into the side cavity 256 of the first locking sheath 254 to be locked (as shown in FIG. 7) and/or to be removed from the side cavity 256 to be unlocked (as shown in FIG. 6). When the locking gear 260 is received into the sheath's side cavity 256, its outer locking teeth 262 engage the locking sheath's inner locking teeth 258 thereby locking the locking gear 260 in place.

In one example, pushing the pushbutton 250 in and to the right in FIG. 7 causes the shaft 252 and the locking sheath 254 to translate to the right in the direction of the arrow F thereby moving the locking sheath 254 away from the first locking gear 260 and thereby releasing gear 260 from within the sheath's side cavity 256. The result of this is shown in FIG. 6, with the first locking gear 260 and the first engagement gear 264 free to rotate about the shaft 252. Conversely, releasing the pushbutton 250 causes the spring-loaded button 250, the shaft 252, and the locking sheath 254 to move to the left such that the locking sheath 254 engages the first locking gear 260 (the locking gear 260 is received into the sheath's side cavity 256) thereby locking it in place. It is understood that the assembly's right side rotational control mechanism 248 operates in a similar fashion.

The tilting of the tray assembly 200 with respect to the floor stand assembly 100 will be described next.

Figure 8:
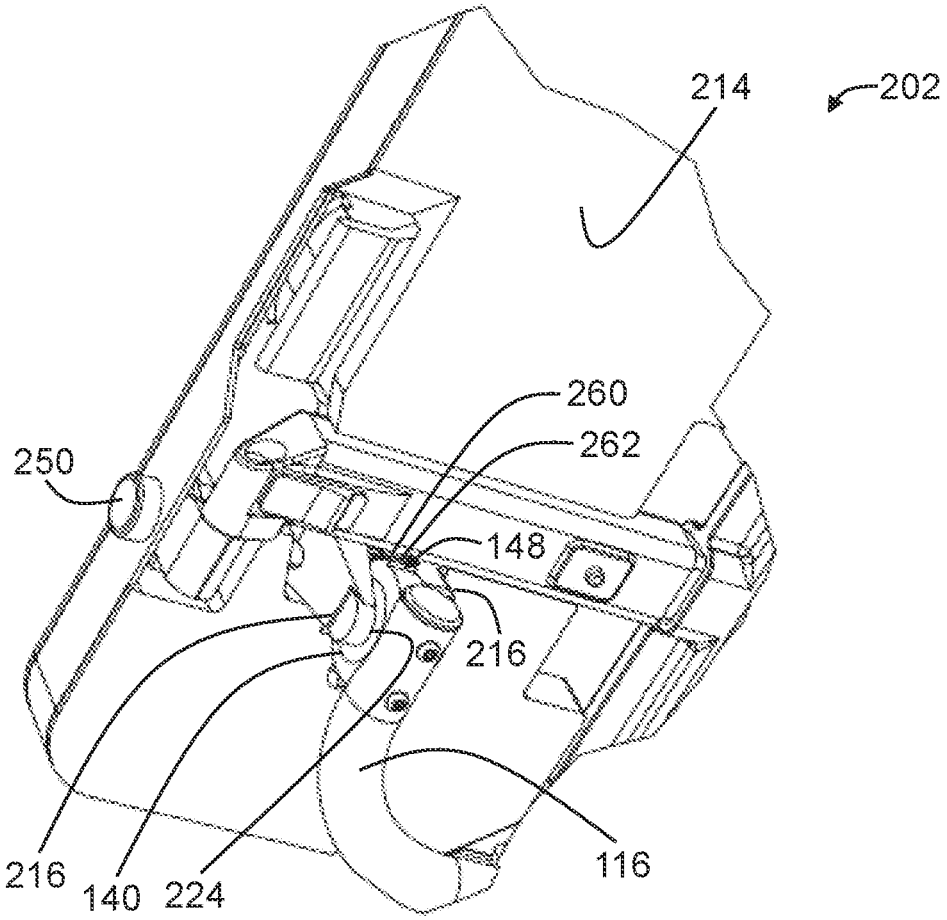
FIG. 8 shows aspects of a tray assembly and a floor stand assembly according to exemplary embodiments hereof.

FIG. 8 shows the left engagement disc 140 of the tray support 106 engaged within the left engagement clamp 216. As shown, the engagement disc 140 is held within the clamp 216 and able to rotate within the clamp 216 about the centered side protrusion 224. In some embodiments, the upper circumferential surface of the engagement disc 140 includes one or more upper engagement teeth 143 extending radially outward. In the configuration of FIG. 8, the engagement disc's upper engagement teeth 143 may engage with the engagement teeth 266 of the first engagement gear 264. In this way, the first engagement gear 264 (e.g., whether it is locked or unlocked) may affect the rotational movement of the engagement disc 140 about the protrusion 224 within the clamp 216.

For example, with the pushbutton 250 pressed in and to the right, the first engagement gear 264 is free to rotate thereby allowing the engagement disc 140 also to rotate (within the clamp 216). In this configuration (along with the right side rotational control mechanism 248 similarly activated), the entire tray assembly 200 may be tilted with respect to the floor stand assembly 100. Then, once the tilt angle of the tray assembly 200 is chosen, the pushbutton(s) 250 may be released (on both the left and right sides) causing the locking sheaths 254 to engage the locking gears 260 thereby locking the gears 260, the engagement discs 140, 142 and the entire tray assembly 200 in place at the desired tilt angle.

The tilting of the tray 202 with respect to its left and right folding legs 226, 228 will be described next.

Figure 9:
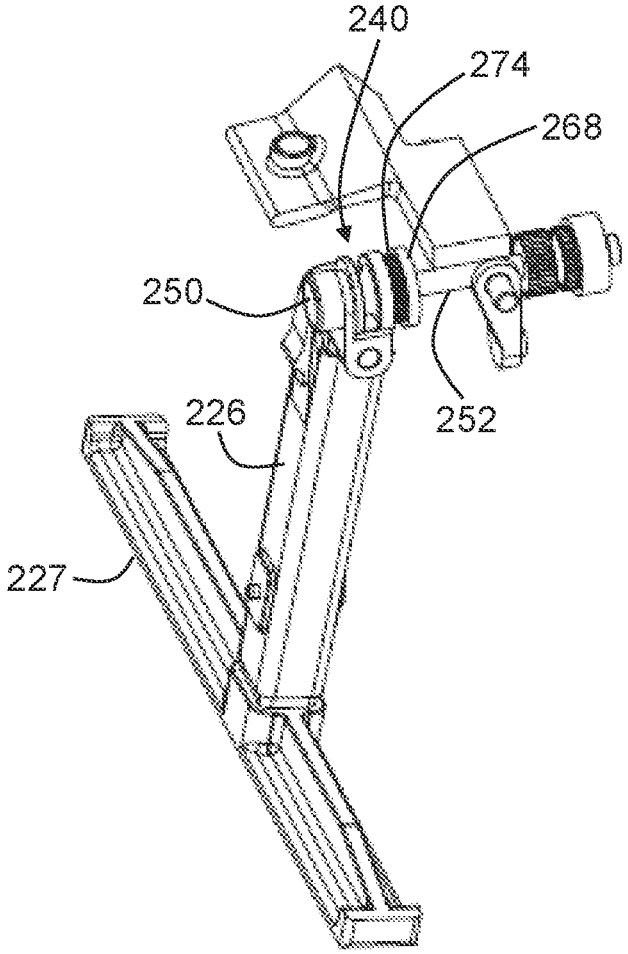
FIG. 9 shows aspects of a tray assembly according to exemplary embodiments hereof.

In some embodiments, as shown in FIGS. 6, 7, and 9, the rotational control mechanism 248 includes a second locking sheath 268 fixedly coupled about the circumference of the shaft 252 towards the shaft's distal end such that longitudinal movement of the shaft 252 also causes longitudinal movement of the second locking sheath 268. The second locking sheath 268 includes a side cavity 270 including inner engagement teeth 272 on an inner circumferential surface within the cavity 270.

In some embodiments, as shown in FIGS. 6 and 9, the rotational control mechanism 248 includes a second locking gear 274 rotationally coupled to the shaft 252 and including outer circumferential locking teeth 276.

In some embodiments, as shown in FIGS. 6-7, the second locking gear 274 is adapted to be received into the side cavity 270 of the second locking sheath 268 to be locked (with the pushbutton 250 released as shown in FIG. 7) and/or to be removed from the side cavity 270 to be unlocked (with the pushbutton 250 pressed in and to the right as shown in FIG. 6). When the second locking gear 274 is received into the second sheath's side cavity 270, its outer locking teeth 276 engage the locking sheath's inner locking teeth 272 thereby locking the locking gear 274 in place.

FIG. 9 shows an isolated view of the rotational control mechanism 248 and the tray assembly's left folding leg 226 in its extended position (for use as a bed stand). In this configuration, the second locking gear 274 is fixedly coupled with the folding leg 226 such that controlling the second locking gear 274 may affect the rotational movement of the leg 226. That is, with the second locking gear 274 locked (when the pushbutton 250 is released to the left), the rotational movement of the leg 226 also is locked, and with the second locking gear 274 unlocked and free to rotate (when the pushbutton 250 is pressed in), the rotational movement of the leg 226 also is unlocked and the leg 226 is free to rotate.

Accordingly, to rotate the left folding leg 226 with respect to the tray 202, the pushbutton 250 is pressed inward, the second locking gear 274 is unlocked, and the tray 202 may be tilted with respect to the leg 226. Subsequently, when the tray 202 is tilted to a desired angle, the pushbutton 250 may be released thereby locking the second locking gear 274 and the coupled leg 226 in place. It is understood that the side rotational control mechanism 248 is similarly configured with the right folding leg 228 and that its activation may be required in parallel to left side rotational control mechanism 248 to unlock and lock the tray 202 with respect to the left and right legs 226, 228.

Folding the Assembly 10

Figure 10:
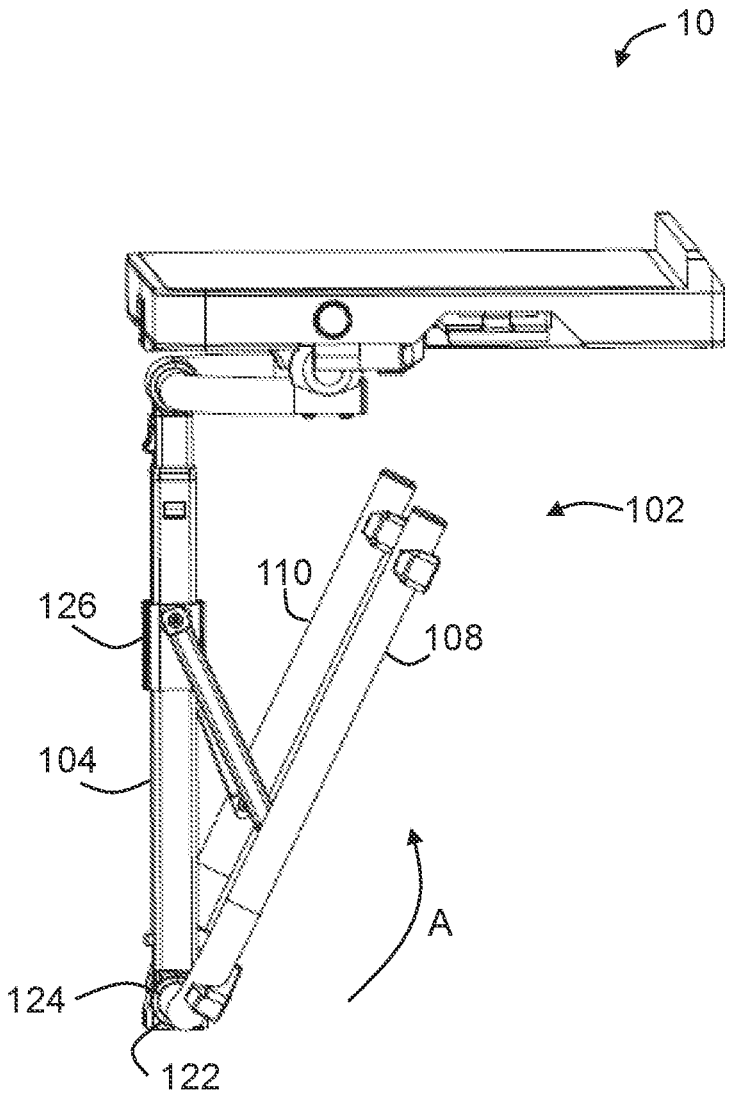
FIGS. 10-12 show aspects of combination stand according to exemplary embodiments hereof.
Figure 11:
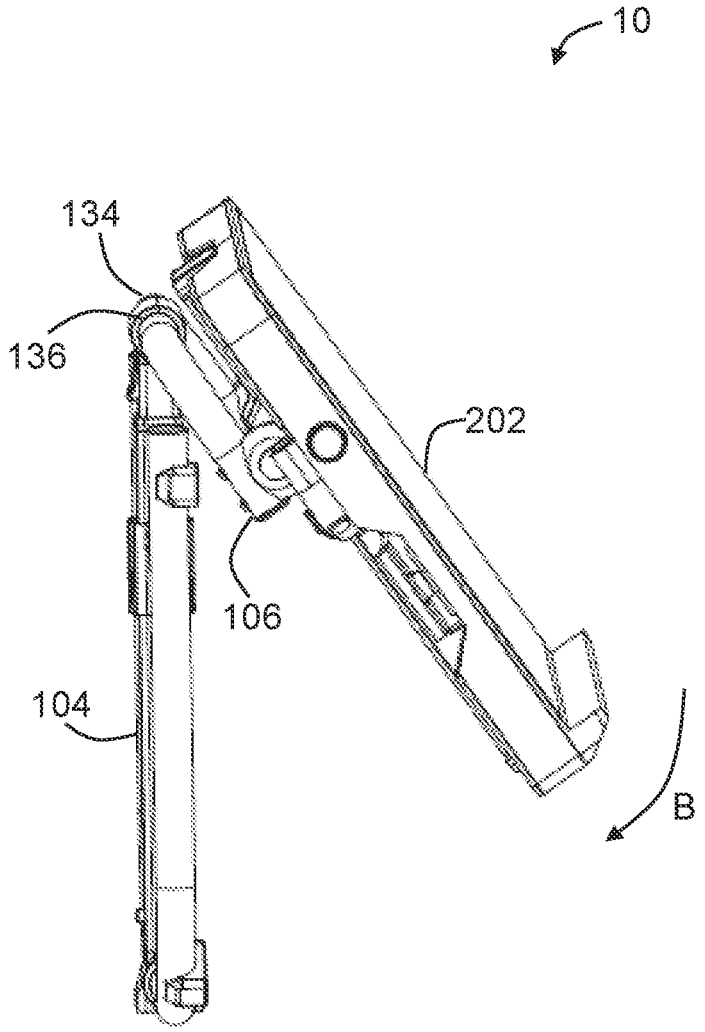
Figure 12:
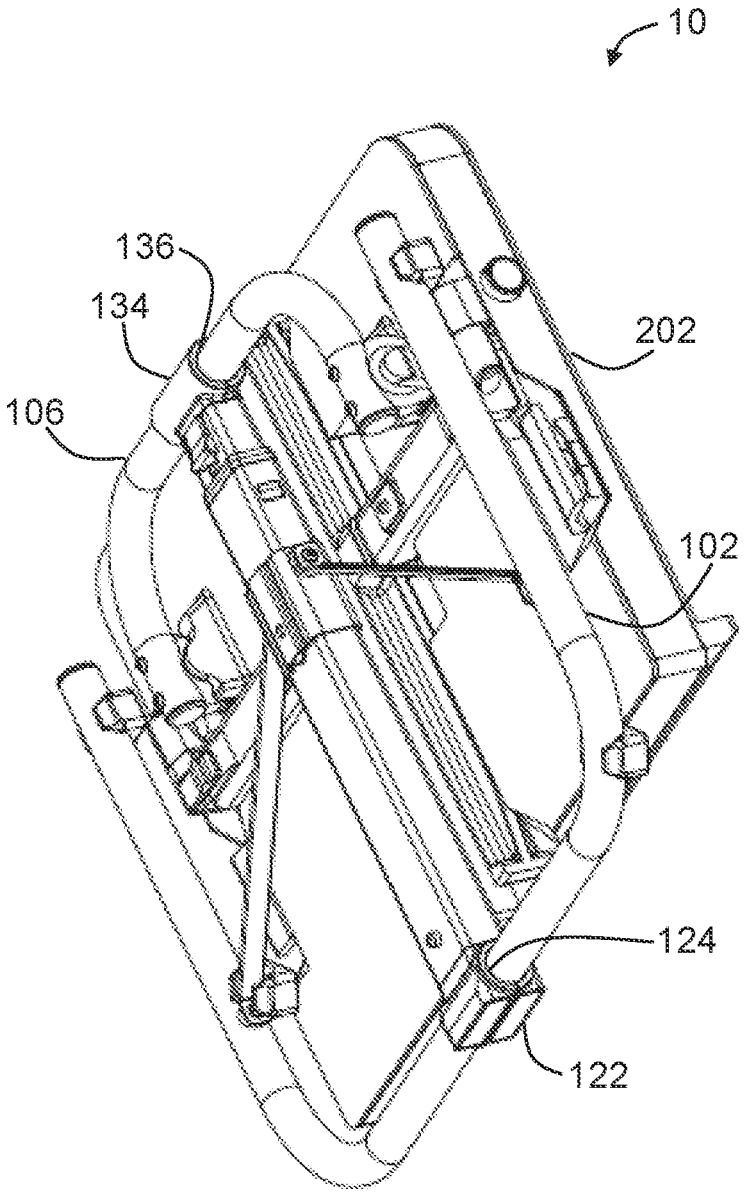

In some embodiments as shown in FIGS. 1 and 10-12, the assembly 10 is designed to transition from a first (extended) configuration for usage as a floor stand shown in FIG. 1 to a second (folded) configuration for stowage as shown in FIGS. 10-12.

As described above with reference to FIGS. 2-3, and now turning to FIG. 10, with the sheath's 126's locking pin-hole combination 132 activated to release the sheath 126, and as the sheath 126 is caused to move upward in the direction of the arrow C along the upright support structure 104, the left and right sheath support arms 128, 130 pull the base's 102's left and right legs 108, 110, respectively, causing the left and right legs 108, 110 and the overall base 102 to rotate upward in the direction of the arrow A about the lower coupler's 122's through-hole 124. It may be preferable for the rotation of the base 102 to continue until the base 102 is generally flush and parallel with the upright support structure 104 to minimize the assembly's 10's footprint in this configuration for stowage.

Next, as described above with reference to FIGS. 2-3, and now turning to FIG. 11, with the tray support's 106's upper coupler's 134's locking mechanism 138 released to enable the tray support 106 to be folded downward, the tray support 106 (and the tray 202 coupled to the tray support 106) may rotate downward in the direction of the arrow B about the upper coupler's through-hole 136. It may be preferable for the rotation of the tray support 106 and the tray 202 to continue until the tray 202 is generally flush and parallel with the upright support structure 104 to minimize the assembly's 10's footprint in this configuration for stowage.

The result of the above actions may result in the folded configuration of the overall assembly 10 shown in FIG. 12.

It is understood that the steps described above are meant for demonstration and that additional steps may be performed, not all of the described steps may be performed, and the steps may be taken in different orders. It also is understood that the scope of the assembly 10 is not limited in any way by the steps taken during its use.

It also is understood that any aspect and/or element of any embodiment of the assembly 10 described herein or otherwise may be combined with any other aspect and/or element of any other embodiment described herein or otherwise in any way to form additional embodiments of the assembly 10 all of which are within the scope of the assembly 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs,"

means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A stand assembly comprising:

a base adapted to rest on a surface;

an elongate support including a proximal end coupled to the base and a distal end extending upward away from the base;

a tray support coupled to the distal end of the elongate support;

a tray releasably coupled to the tray support, the tray including a tray top side and a tray underside;

a first tray leg rotatably coupled to the tray underside towards a left side of the tray and adapted to rotate from a first position to a second position, the first position including the first tray leg substantially overlapping the tray underside and the second position including the first tray leg extending downward away from the tray underside;

a second tray leg rotatably coupled to the tray underside towards a right side of the tray and adapted to rotate from a third position to a fourth position, the third position including the second tray leg substantially overlapping the tray underside and the fourth position including the second tray leg extending downward away from the tray underside;

a first locking mechanism configured with the tray and adapted to lock the tray at a first angle of rotation with respect to the tray support when the tray is releasably coupled to the tray support; and a second locking mechanism configured with the tray and adapted to lock the tray at a second angle of rotation with respect to the first tray leg and/or with respect to the second tray leg when the tray is released from the tray support and the first leg is in the second position and/or the second tray leg is in the fourth position.

2. The stand assembly of claim 1 wherein the tray support includes a first arm including a first engagement mechanism and a second arm including a second engagement mechanism, and the tray includes a first engagement clamp adapted to releasably grip the first engagement mechanism and a second engagement clamp adapted to releasably grip the second engagement mechanism.

3. The stand assembly of claim 2 wherein the first engagement mechanism includes at least one first engagement mechanism tooth and the first locking mechanism includes at least one first engagement mechanism locking tooth adapted to releasably engage the at least one first engagement mechanism tooth, and/or the second engagement mechanism includes at least one second engagement mechanism tooth and the first locking mechanism includes at least one second engagement mechanism locking tooth adapted to releasably engage the at least one second engagement mechanism tooth.

4. The stand assembly of claim 3 wherein the first locking mechanism includes a first activation mechanism adapted to releasably lock the at least one first engagement mechanism locking tooth, and/or a second activation mechanism adapted to releasably lock the at least one second engagement mechanism locking tooth.

5. The stand assembly of claim 2 wherein the first engagement mechanism includes a first engagement disc, and/or the second engagement mechanism includes a second engagement disc.

6. The stand assembly of claim 5 wherein the first engagement disc is rotatable within the first engagement clamp and/or the second engagement disc is rotatable within the second engagement clamp.

7. The stand assembly of claim 2 wherein the tray includes a first activation mechanism adapted to cause the activation and/or deactivation of the first engagement clamp with the first engagement mechanism, and/or a second activation mechanism adapted to cause the activation and/or deactivation of the second engagement clamp with the second engagement mechanism.

8. The stand assembly of claim 7 wherein the activation mechanism includes a first button and/or the second activation mechanism includes a second button.

9. The stand assembly of claim 1 wherein the first tray leg includes at least one first tray leg engagement tooth and the second locking mechanism includes at least one first tray leg locking tooth adapted to releasably engage the at least one first tray leg engagement tooth, and/or the second tray leg includes at least one second tray leg engagement tooth and the second locking mechanism includes at least one second tray leg locking tooth adapted to releasably engage the at least one second tray leg engagement tooth.

10. The stand assembly of claim 9 wherein the second locking mechanism includes a first activation mechanism adapted to cause the engagement and/or disengagement of the at least one first tray leg locking tooth with the at least one first tray engagement tooth, and/or a second activation mechanism adapted to cause the engagement and/or disengagement of the at least one second tray leg locking tooth with the at least one second tray engagement tooth.

11. The stand assembly of claim 10 wherein the first activation mechanism includes at least one of a first button and a first paddle, and/or the second activation mechanism includes at least one of a second button and a second paddle.

12. The stand assembly of claim 1 wherein the tray support is adapted to transition from a first position generally perpendicular to the elongate support to a second position generally parallel to the elongate support.

13. The stand assembly of claim 1 wherein the base is adapted to transition from a first position generally perpendicular to the elongate support to a second position generally parallel to the elongate support.

14. The stand assembly of claim 1 wherein the elongate support is telescoping.

15. The stand assembly of claim 1 wherein the first tray leg and/or the second tray leg is telescoping.

16. The stand assembly of claim 1 wherein the base includes a U-shaped structure.

17. The stand assembly of claim 1 wherein the tray support includes a U-shaped structure.

18. The stand assembly of claim 1 wherein the tray is rotatable with respect to the tray support.

19. The stand assembly of claim 1 wherein the tray is rotatable with respect to the first tray leg and/or the second tray leg.

20. The stand assembly of claim 1 wherein the tray includes at least one underside cavity adapted to receive the first tray leg when the first tray leg is in the first position and/or the second tray leg when the second tray leg is in the third position.

* * * * *